United States Patent [19]

Kurosawa

[11] Patent Number: 5,074,213

[45] Date of Patent: Dec. 24, 1991

[54] THERMOREGULATOR OF A BLOCK CYLINDER USED FOR AN OFFSET PRESS

[76] Inventor: Seiichi Kurosawa, No. 2225 Suzukouya, Katsuramura, Ibaragigun, Ibaragi Pref., Japan

[21] Appl. No.: 443,867

[22] Filed: Nov. 30, 1989

Related U.S. Application Data

[63] Continuation of Ser. No. 90,539, Aug. 28, 1987, abandoned.

[51] Int. Cl.[5] ..... B41L 35/14

[52] U.S. Cl. ..... 101/487; 101/216

[58] Field of Search ..... 101/219, 216, 211, 212, 101/487; 165/88, 89, 90, 90 H, 89 H; 62/332, 434, 381

[56] References Cited

U.S. PATENT DOCUMENTS

| | | | |
|---|---|---|---|
| 1,672,036 | 6/1928 | Oltman | 165/89 H |
| 2,025,046 | 12/1935 | Goedike | 101/147 |
| 2,260,364 | 10/1941 | Case | 101/219 |
| 2,971,460 | 2/1961 | Shindle | 101/487 |
| 2,972,298 | 2/1961 | De Marchi et al. | 101/211 |
| 2,972,301 | 2/1961 | Gessler et al. | 101/211 |
| 2,989,917 | 6/1961 | Brodie | 101/211 |
| 3,156,101 | 11/1969 | McGuffey | 62/434 |
| 3,452,967 | 7/1969 | Durand | 165/90 H |
| 4,107,944 | 8/1978 | Eskeli | 165/88 |
| 4,183,298 | 1/1980 | Cappel et al. | 165/96 |
| 4,319,462 | 3/1982 | Fester | 62/434 |
| 4,617,864 | 10/1986 | Niedermaier et al. | 101/219 |
| 4,729,424 | 3/1988 | Mizuno et al. | 62/175 |
| 4,920,881 | 5/1990 | Tafel | 101/424.1 |

*Primary Examiner*—Edgar S. Burr
*Assistant Examiner*—John S. Hilten
*Attorney, Agent, or Firm*—Oldham & Oldham Company

[57] ABSTRACT

A thermoregulator of a block cylinder used for an offset press which prevents the surface temperature of a block from rising, and at the same time allows it to maintain the said temperature at the most suitable point for printing.

6 Claims, 6 Drawing Sheets

THERMOREGULATOR OF A BLOCK CYLINDER USED FOR AN OFFSET PRESS

This is a continuation of co-pending application Ser. No. 07/090,539 filed on Aug. 28, 1987, abandoned.

FIELD OF THE INVENTION

The present invention relates to a thermoregulator of a block cylinder used for an offset press.

DESCRIPTION OF THE PRIOR ART

In an offset press, printing is actuated by first transferring an image of a printing block to a rubber blanket and further transferring the same to printing paper. At that point, oily ink is applied to an image portion of the block and the remaining portion is damped with water so as to repel ink.

In such a conventional offset press as above, there is provided a block cylinder 11, that is, a cylinder on which the printing block is mounted, a rubber blanket cylinder 12 and a compressing cylinder 13, as explained with reference to FIG. 2 and FIG. 6.

When printing is actuated by employing the aforementioned offset press, three cylinders 11–13 are synchronizely rotated in the direction of each arrow. When the block cylinder 11 is rotated, water is suitably applied to a printing block 14 mounted about the surface of said block cylinder 11 from a water form roller 15, and ink is also suitably applied thereto from an ink form roller 16. A plurality of said ink form rollers are thus arranged.

Ink applied to the block 14 is transferred to a rubber blanket 17 wound about the surface of a rubber blanket cylinder 12. The ink thus transferred is supplied to the surface of a compressing cylinder 13 and then transferred to printing paper 20 wound about the surface of the compressing cylinder 13 by pressing down the tip portion of said printing paper. Thus, printing is transferred onto the printing paper 20.

According to such a conventional press as described above, oily ink is applied to the image portion of the block 14 and the remaining portion (non-image portion) is dampened with water so as to repel ink. This is because of the fact that a small amount of water may be applied to said non-image portion of the block 14 and ink may precisely be applied only to the image portion thereof by utilizing the mutually repulsive property of water and oily ink.

For this reason, according to such a conventional offset press there is provided a water tank, and the water dispensed therefrom by means of dispensing roller is supplied to the water form roller 15, and the water is thereafter suitably applied to the block 14 as described above.

However, according to such a conventional offset press, water is continuously applied to the block 14 by means of the water form roller 15 during through printing, and accordingly, a considerably high degree of technique is necessary for the application of ink and water onto the surface of the block 14, which inevitably requires a high degree of skill.

In addition, since the block 14 rotates in contact with a plurality of ink rollers 16 and the rubber blanket 17, frictional heat generates at those points, and further, said block 14 is also affected by room temperature. Thus the surface temperature of the block 14 rises, and further, the surface of the rotating block 14 is exposed to air currents. For this reason, following application of ink and water onto the surface of the block 14, a small amount of the water applied to the non-image portion of the block 14 dries during printing, which results in soiling the surface of the block 14, and the image portion thereof (a fatty acid soap layer) is damaged, deteriorating the quality of the image.

In order to solve the above problem, that is to say, in order to prevent water applied to the block 14 from drying out during through printing without the necessity of a considerable high degree of skill, in the case of a conventional offset press, somewhat greater amounts of water are applied thereto, or etchants are sometimes mixed with the above water. However, an excess amount of water or etchants is apt to be kneaded into the ink roller 16, and as a result, the oily ink loses its inherent viscosity or stability and then it becomes emulsified. Accordingly, the surface of the block 14 becomes dirty, and further, the glossiness of ink is lost and the quality of image is considerably deteriorated. Furthermore, when the etchants are mixed with water to be applied, the surface of the ink roller 16 is damaged thereby and its life is lessened.

In any event, according to a conventional offset press, there has been found that as a result of such defects, proper maintainance of the block during printing is considerably troublesome, the image is apt to be deteriorated, and further, the life of the block 14 is shortened, which results in lowering printing efficiency.

SUMMARY OF THE INVENTION

The present invention was achieved in view of the aforementioned facts, and an object of the present invention is to provide a thermoregulator for the block cylinder used in an offset press so that the surface temperature of the block does not rise and at the same time the temperature can be maintained to be most suitable for a printing condition.

The aforementioned objects can be attained by a thermoregulator of a block cylinder used for an offset press comprising a cooling liquid on the inside of a block cylinder with a block, mounted thereon, a cooling tube for cooling said liquid provided inside of said cylinder, a cooler for supplying a refrigerant to a cooling tube inside said block cylinder from the outside of said cylinder, and a controlling means for controlling cooling action of said cooler, depending upon the temperature of the liquid within said cylinder.

According to the present invention, a peripheral wall of the block cylinder is cooled because the liquid is first cooled, and then the block is cooled. Accordingly, the surface temperature of the block does not rise, and water applied to the non-image portion thereof does not easily dry. Furthermore, the surface temperature of the block can be maintained to provide the most suitable printing condition by controlling cooling action of the cooler.

BRIEF DESCRIPTION OF THE DRAWINGS

In the Figures.

FIG: 2 is a perspective view of a main portion of said offset press.

Figure 1:
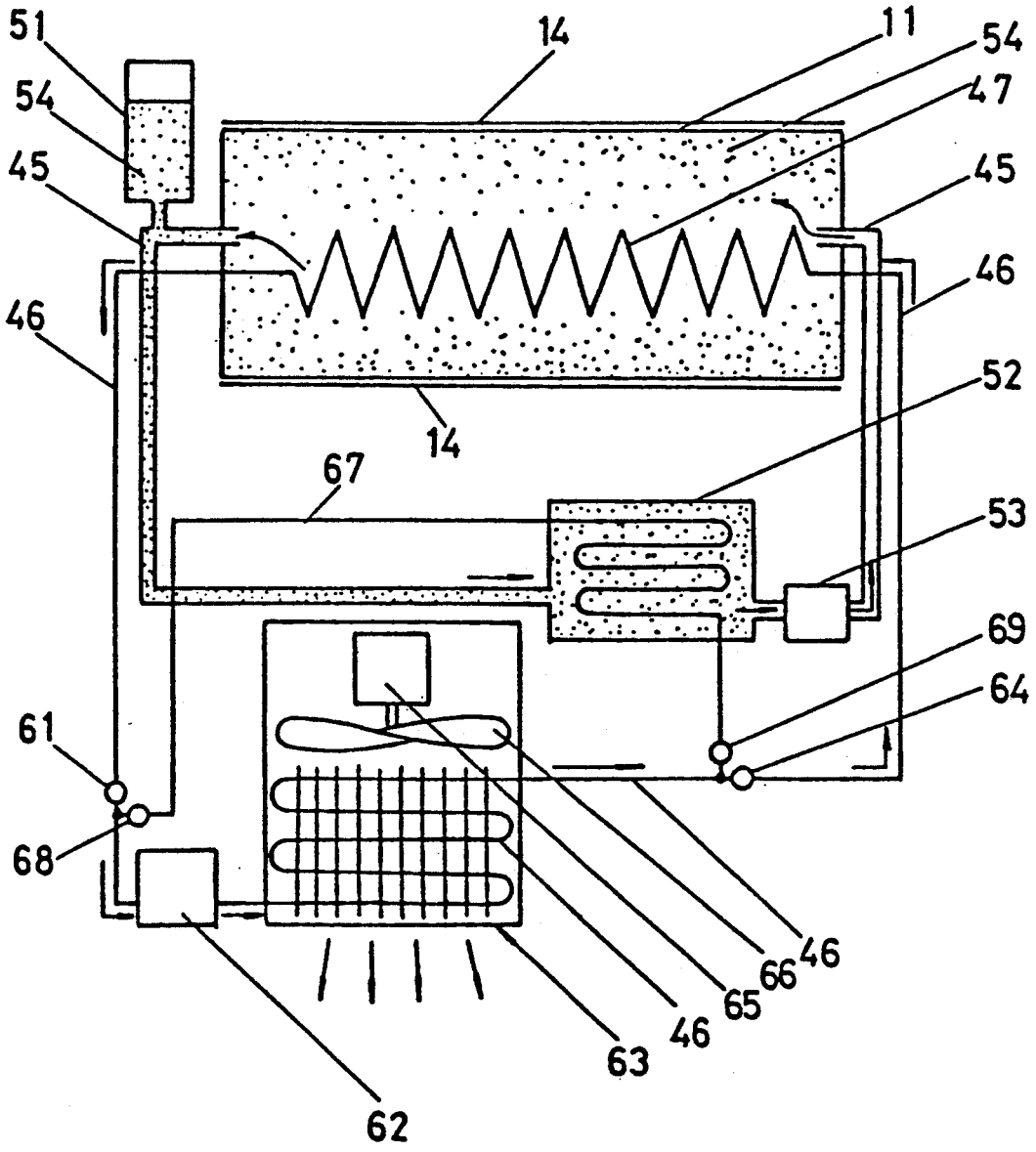
FIG. 1 is a schematic view showing one embodiment of an offset press according to the present invention.
Figure 2:
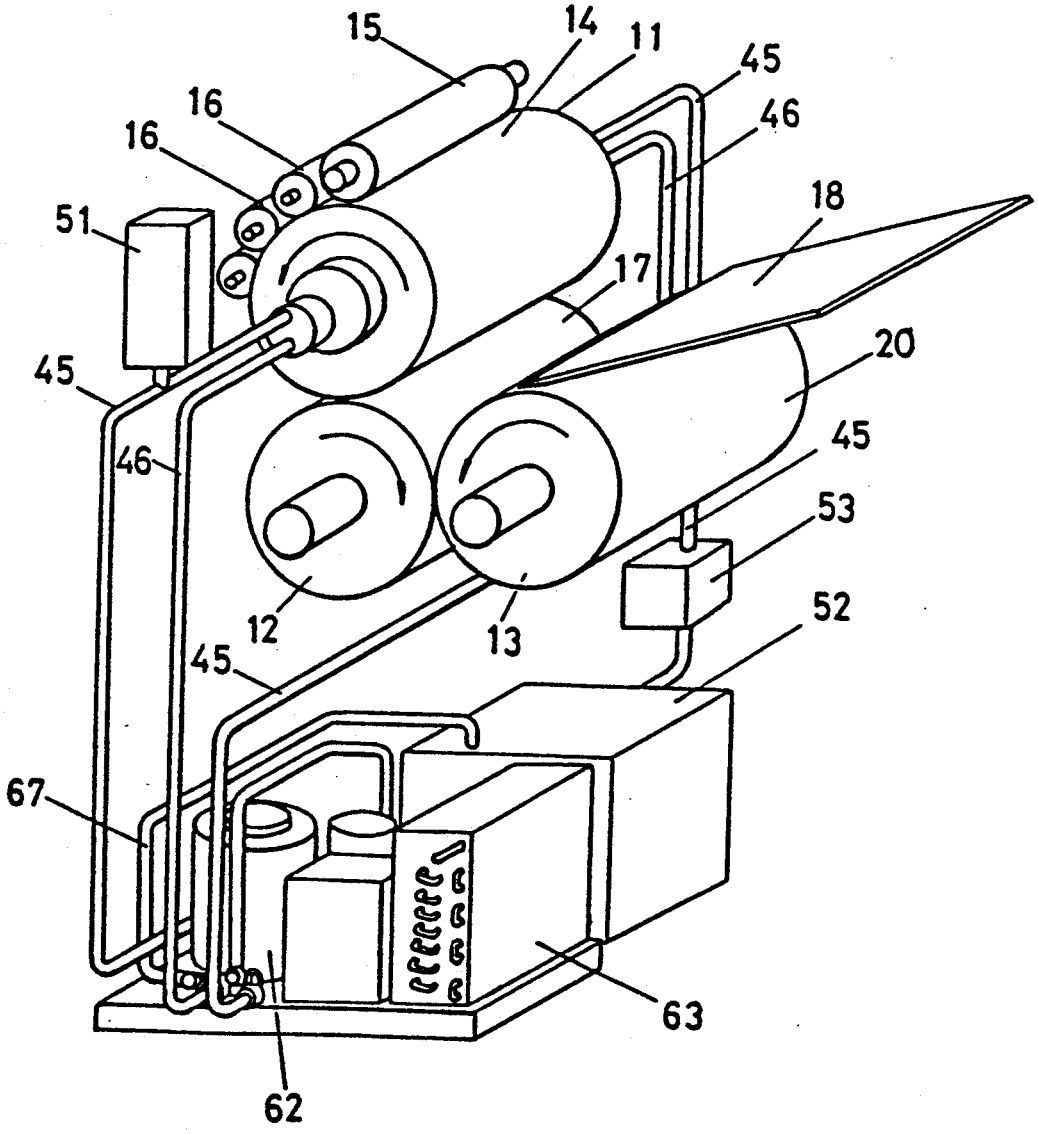
Figure 3:
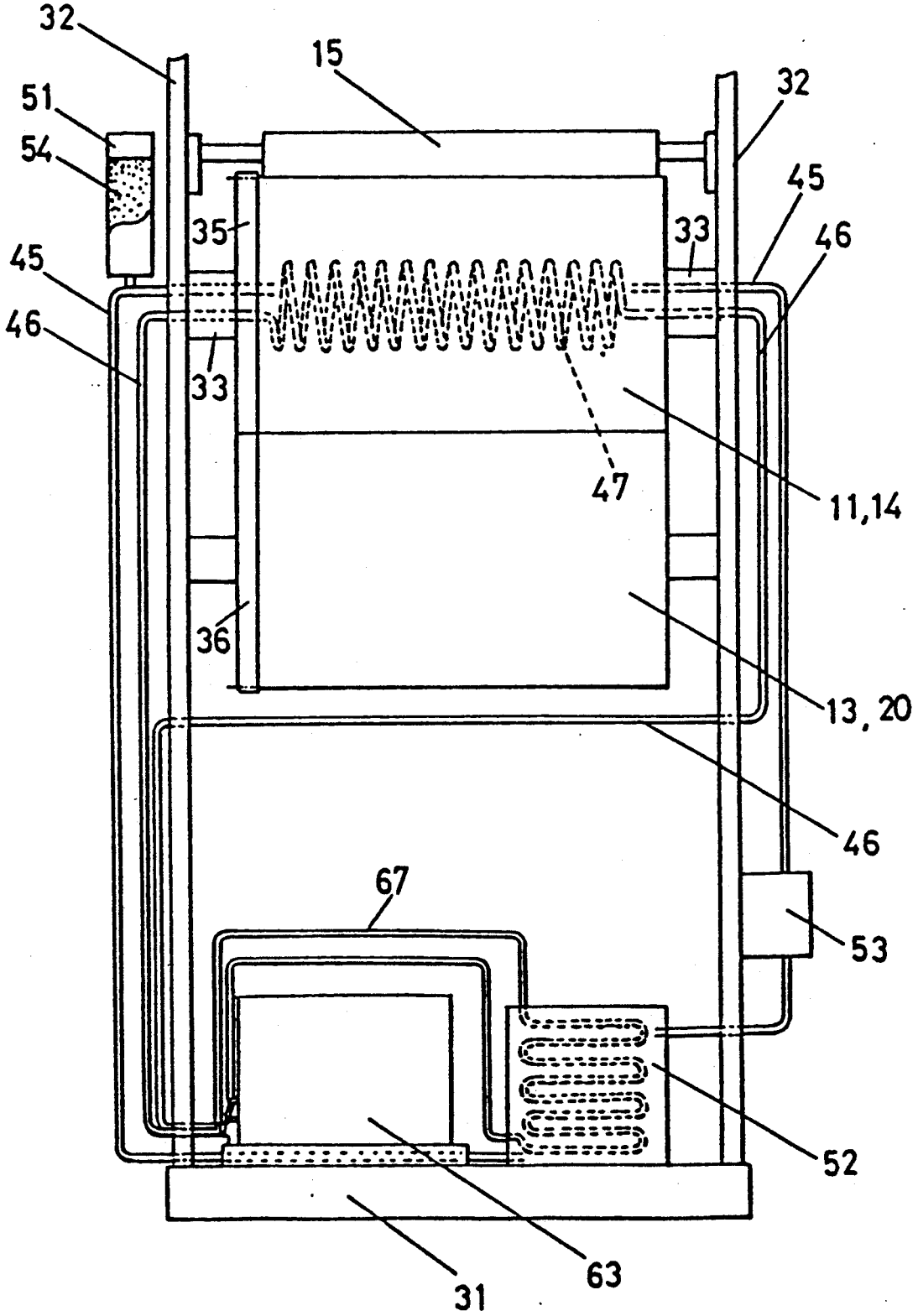

FIG. 3 is a front view of a main portion of said offset press.

Figure 4:
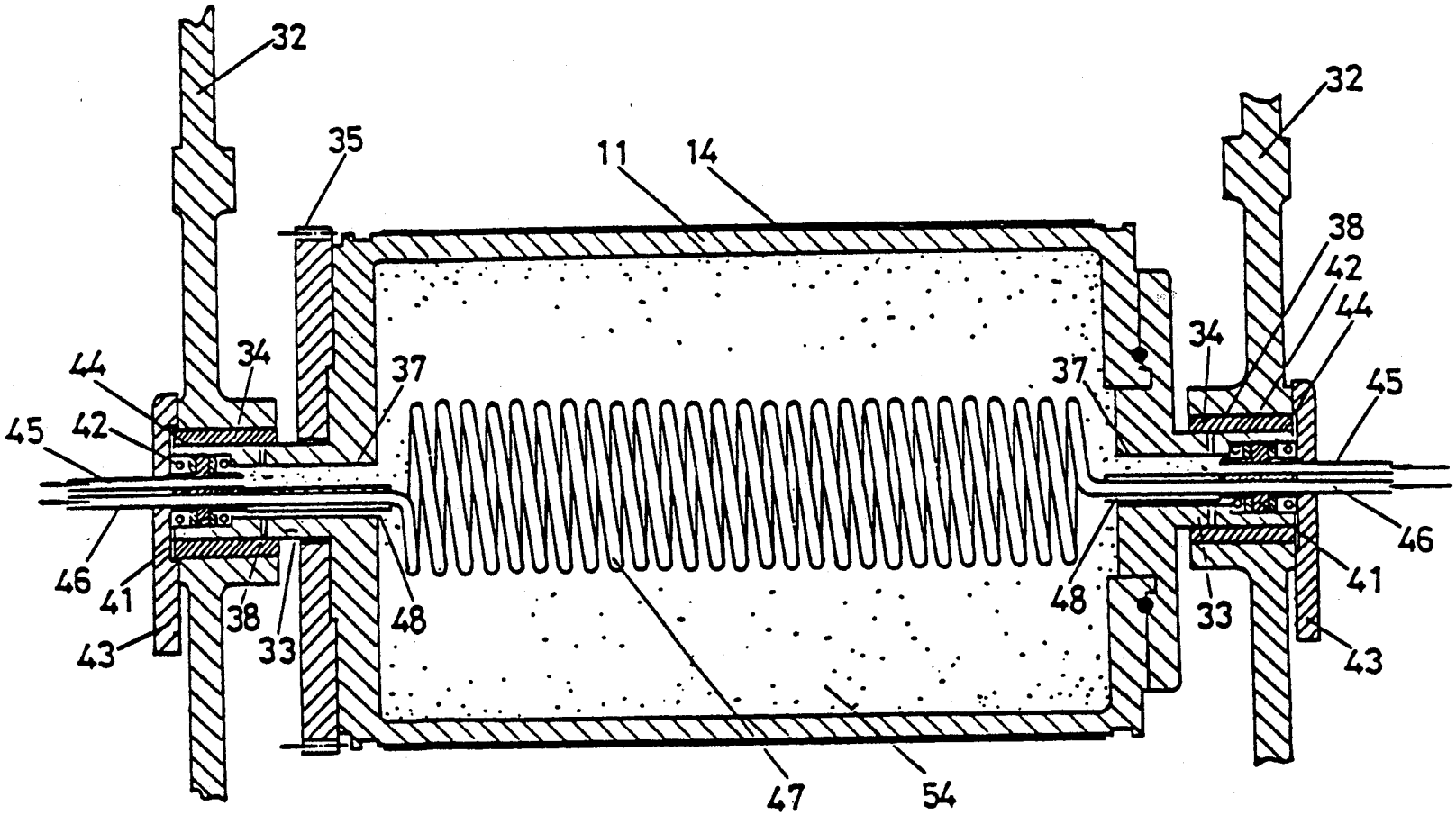

FIG. 4 is a longitudinal sectional view of one portion of said offset press.

Figure 5:
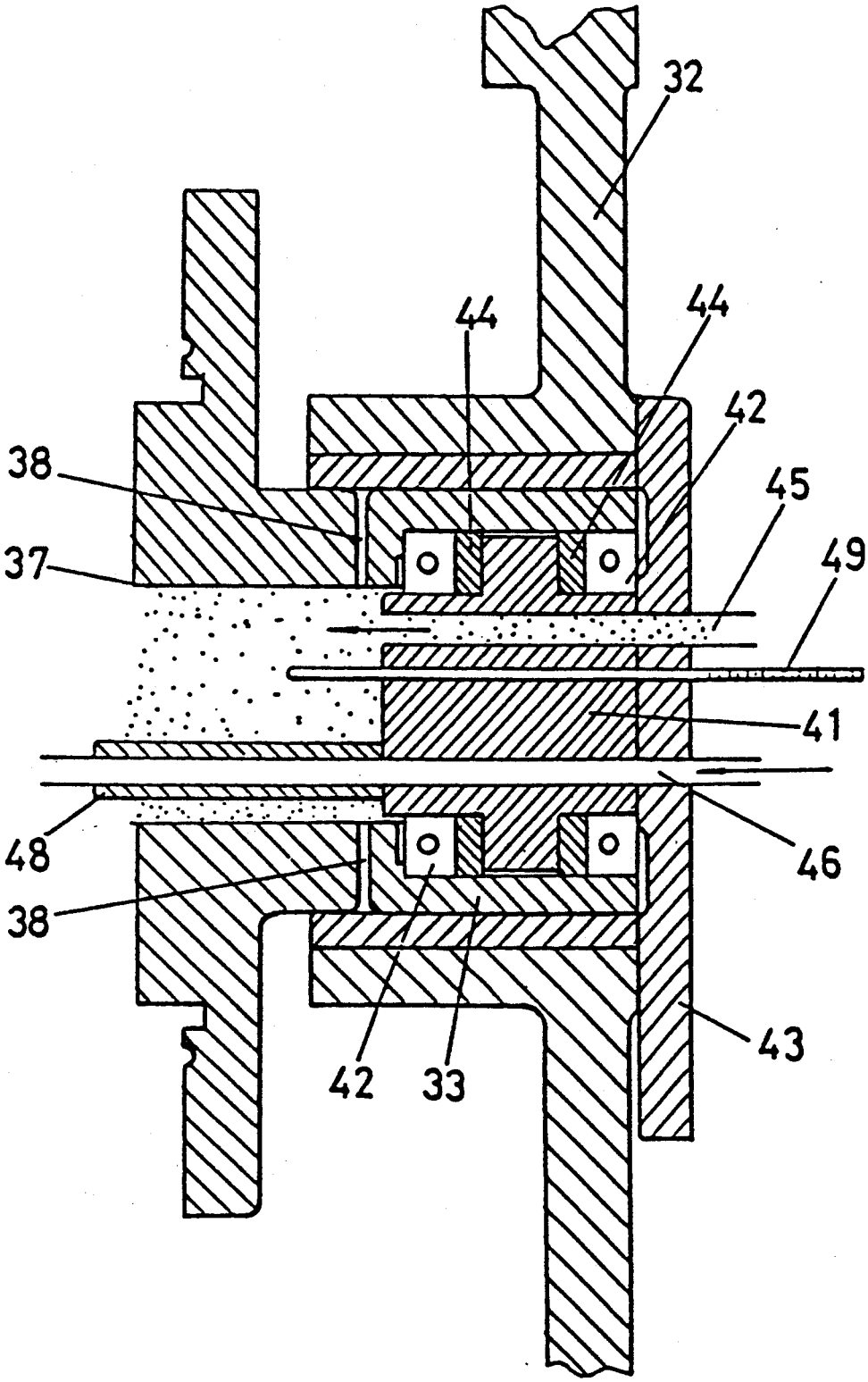

FIG. 5 is a detailed view of one portion illustrated in FIG. 4, and

Figure 6:
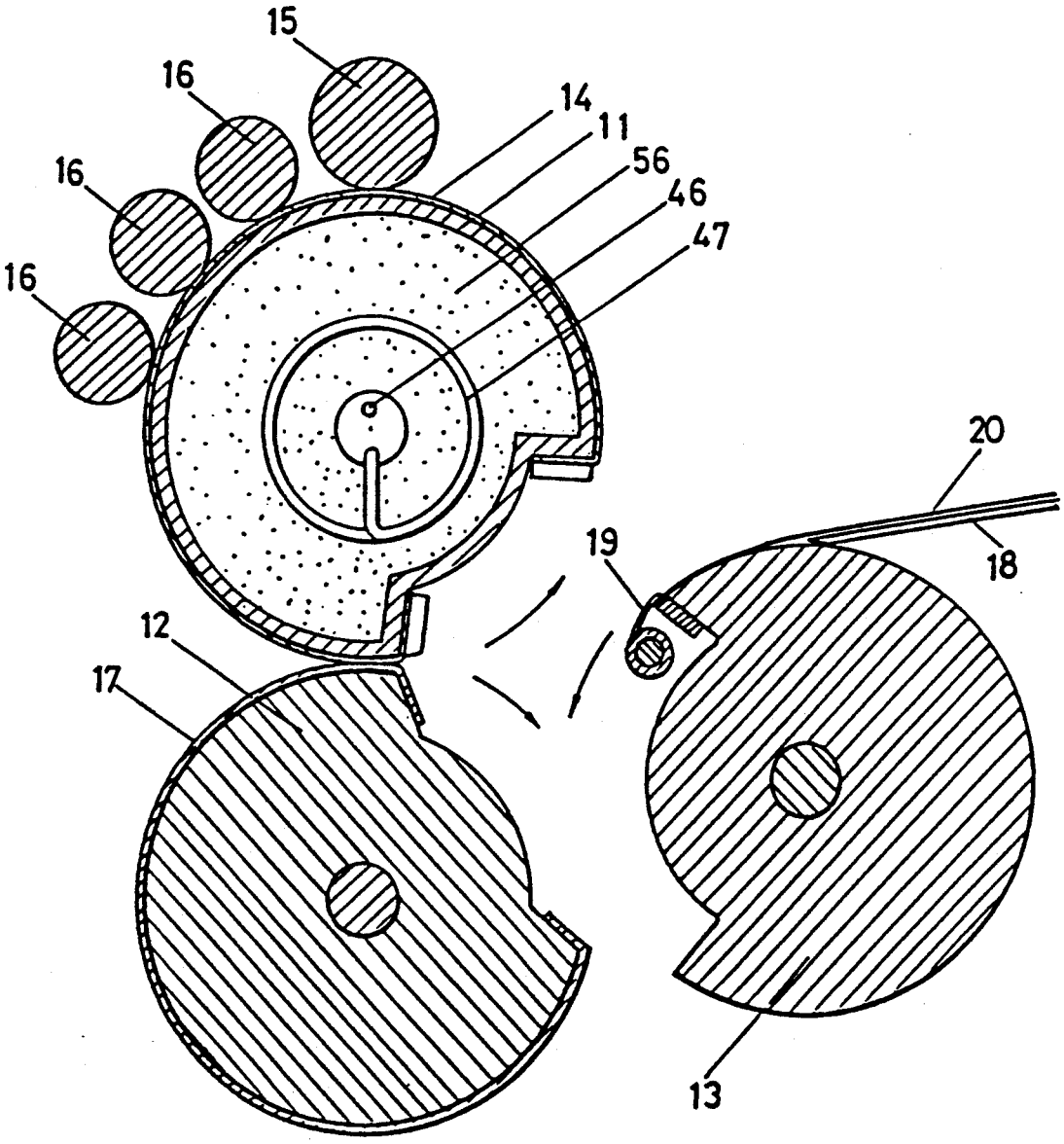

FIG. 6 is a longitudinal sectional side view of one portion of said offset press.

EXAMPLE

Hereinafter, the present invention will be described in more detail with reference to the embodiment thereof.

Said offset press includes a block cylinder 11, a rubber blanket cylinder 12, and a compressing cylinder 13, and printing is performed by the same printing process as in the case of a conventional offset press as above described. Accordingly, an explanation as to printing by means of the present offset press is omitted.

According to the offset press of the present invention, the block cylinder 11, the rubber blanket cylinder 12, and the compressing cylinder 13 are fixed rotatably free to a pair of machine frames mounted at a base 31.

Both axes 33 of block cylinder 11 are fixed rotatably free to the machine frame 32 through a bearing 34. A gear 35 is disposed at the axis on one side. Said gear 35 engages with a gear 36 of the rubber blanket cylinder 12, and the gear 36 engages with a gear (not illustrated) of the compressing cylinder 13, thereby rotating three cylinders each 11–13 synchronously. An annular penetrating hole 37 is disposed at the axis 33, and a communicating hole 38 is provided which communicates with said penetrating hole 37 to the inside of the bearing 34.

A plug 41 is relatively fixed rotatably free into the axis 33 of the block cylinder 11 through the bearing 42. Said plug 41 is mounted onto a lid 43 fixed to the machine frame 32, thereby preventing the plug 41 from rotation, but permitting the axis 33 to rotate thereabout. A space between the plug 41 and the axis 33 is sealed by an oil seal 44. An oil tube 45 and a refrigerant tube 46 are, respectively, inserted into the plug 41 and the lid 43, penetrating therethrough. Said refrigerant tube 46 is connected to a cooler 47 in the form of a coil disposed in the middle portion of the inner space of the block cylinder 11. In FIG. 4, the refrigerant tube 46 disposed at the right side is smaller than the cooling tube 47 and the refrigerant tube 46 disposed at the left side. For example, the inner diameter of the former is around 1.5 mm, and that of the latter is around 4.5 mm. Both ends of the cooling tube 47 in the form of a coil are reinforced by a cylindrical body 48 mounted at the plug 41. A thermometer 49 is inserted into the plug 41 at one side, and the lid 43, penetrating therethrough.

An oil tank 51, an oil cooling tank 52, and a pump 53 are located in sequence along oil tube 45. When the pump 53 is driven, the oil 54 filled within the inner space of the block cylinder 11 is introduced into the oil cooling tank 52, and thereafter said oil is forced to return to the inner space of the block cylinder 11 after passing through said oil cooling tank 52. Since the oil 54 is also supplied to the space between the axis 33 and the bearing 34 through the communicating hole 38, it is not necessary to supply lubricating oil to said space. The oil tank 51 is mounted to replenish said oil 54.

A cock 61, a compressor 62, a cooler 63 and a cock 64 are located in sequence along refrigerant tube 46. The cooler 63 is provided with a fan 66 rotated by means of a motor 65 so as to cool a cooling medium consisting of freon gas etc within the refrigerant tube 46 disposed at the inside thereof. Furthermore, the cooler 63 controls its cooling action by means of a thermostat (not illustrated). The other refrigerant tube 67 is connected between the refrigerant tube 46 connecting the cock 61 and the compressor 62 and the refrigerant tube 46 connecting the cooler 63 and the cock 64. One portion of said refrigerant tube 67 is disposed within the inside of the oil cooling tank 52. Cocks 68,69 are respectively arranged at the both ends of said refrigerant tube 67.

When printing is commenced with said offset press, the cocks 61,64 are first opened so as allow operation of compressor 62 and the cooler 63. Then, the cooling medium, cooled by means of the cooler 63, is fed into the cooling tube 46 in the form of a coil, thereby cooling the oil 54 within the block cylinder so that a peripheral wall of the block cylinder 11 may be cooled and the block 14 may also be cooled. Since the oil 54 is filled within the block cylinder, the peripheral wall of the block cylinder 11 and the block 14 can be cooled uniformly.

When a surface temperature of the block 14 is excessively high, or the surface temperature thereof is forced to cool abruptly, the cocks 68,69 are further opened so as to cool the oil 54 within the oil cooling tank 52, and at the same time the pump 53 is forced to drive so as to feed the oil cooled by means of the oil cooling tank 52 into the inside of the block cylinder 11.

When the block 14 is cooled to some degree, ink or water is supplied onto the surface of said block 14 so as to carry out a trial printing. At that time, the block cylinder commences to rotate, and accordingly, the oil 54 filled within said block cylinder 11 is suitably agitated, thereby assisting in the uniform cooling of the peripheral wall of the block cylinder 11 and the block 14.

The amount of supply of ink and water onto the surface of the block 14 differs, depending upon a size of a image portion of the block 14 and printing concentration, etc. When a satisfactory print is obtained through the trial printing, it means that the ink and water are well balanced, depending upon the amount of supply of water at that time, that is to say, upon the minimum amount of water. Thus, it can be said that the surface temperature of the block 14 at that time is at the most suitable temperature for printing. When a satisfactory print can be obtained, a temperature of the oil 54 within the block cylinder 11 at that time is measured by employing the thermometer 49, and further, a thermostat of the cooler 63 is set in order to maintain the aforementioned temperature. As an example thereof, when a temperature within a room wherein the offset press is installed is 20° C. to 35° C., the surface temperature of the block 14 is preferably maintained at from 5° C. to 15° C.

When the surface temperature of the block 14 is maintained at a desired temperature, regular printing is commenced. The block 14 is suitably cooled after the commencement of printing, and accordingly, even when an amount of supply of water onto the block 14 is minimal, water applied onto the non-image portion of the block 14 is not dried out during through printing. Another liquid may be employed instead of the oil 54.

By the way, according to the present invention, the block 14 is cooled, and accordingly, it is possible to produce condensation of water vapor on the surface of said block 14 under certain conditions. For example, when a room temperature is 25° C., 30° C. or 40° C. and a surface temperature of the block 14 is 10° C., 15° C. or 20° C., and further when the room humidity is 55–70%, condensation is produced on the surface of the block 14. Accordingly, under such conditions as above, it is possible to suitably dampen the non-image portion of the block 14 without a dampening water supply means consisting of the water form roller etc. On the other hand, when a room temperature is as high as 35°-40° C. and further the room humidity is as low as 37-50%, condensation hardly occurs.

In the latter case, a pipe is arranged, for example, at a distance of about 1 m from the surface of the block 14, and an ultrasonic humidifier is further connected to said pipe so as to atomize moisture out of a plurality of perforations in said pipe in order to keep the humidity on the surface of the block 14 around 70%, thereby producing condensation on the surface thereof.

As described above, according to the present offset press, it is always possible to suitably dampen the non-image portion of the block 14 by virtue of condensation under ordinary circumstances by mounting an atomizer, and thus a dampening water supply means consisting of the water form roller 15 etc can be omitted. Furthermore, it may be possible to mount a pipe for both humidificaton and atomization of etchants, in addition to a pipe for dampening.

As described hereinabove, according to the present invention, it is possible that water applied to the non-image portion of the block will not be dried out during printing; and therefore a quality of image can be improved without the necessity of considerable skill or without supplying a somewhat large amount of water or without mixing etchants therewith. Furthermore, since the surface temperature of the block can be maintained at the most suitable temperature for printing, the quality of the image can be improved even more. Still further, proper maintainance of the block during through printing becomes easy, and the life of the block is also improved, which can enhance printing efficiency.

In cases where it is possible to produce condensation on the surface of block under ordinary room circumstances by mounting an atomizer, it is possible to suitable dampen the non-image portion of the block even when a damping water supply means consisting of the water form roller etc is omitted; and accordingly it becomes possible to decrease the size of the offset press so as to reduce costs considerably.

What is claimed is:

1. In an offset press in which the image of a block is at first transferred to a rubber blanket and further transferred to a printing paper so as to effect printing, an offset press comprising a liquid filled within the inside of a block cylinder on which said block is mounted, a first closed loop heat transfer system to circulate the liquid from said inside of said block cylinder to be cooled by cooling means externally thereof and effect desired heat transfer from said liquid during circulation thereof to provide major temperature control of the liquid, a second closed loop cooling tube mounted inside of said block cylinder providing temperature control of said liquid, a cooler for supplying a cooling medium to said cooling tube from the outside of said block cylinder and a controlling means for controlling cooling action of said cooler depending upon the temperature of the liquid within said block cylinder.

2. An offset press according to claim 1, wherein said liquid is oil or some other liquid introduced into a cooling tank and further returned to an inner space of said cylinder after passing therethrough for cooling a peripheral wall of the block cylinder and the block due to the temperature of the cooled liquid.

3. An offset press according to claim 2, wherein said cooling tube for said cooling medium is formed in the form of a coil and has a larger diameter than that of a refrigerant tube supplying said coil with said cooling medium.

4. An offset press according to claim 3, wherein said cooler provides a fan for cooling a cooling medium consisting of freon gas within the refreigerant tube disposed at the inside thereof.

5. An offset press according to claim 4, wherein said controlling means controls cooling action of the cooler by means of a thermostat.

6. An offset press according to claim 5, wherein, a portion of the freon gas is selectively diverted to effect the heat transfer in the first closed loop heat transfer system.

* * * * *